US009415893B2

(12) United States Patent
Wintermute et al.

(10) Patent No.: US 9,415,893 B2
(45) Date of Patent: Aug. 16, 2016

(54) SHELF READY DISPLAY WITH DUAL DISPENSING FEATURES

(71) Applicant: Mars, Incorporated, McLean, VA (US)

(72) Inventors: William Wintermute, Phillipsburg, NJ (US); Paul Freeman, Cranbury, NJ (US)

(73) Assignee: MARS, INCORPORATED, McLean, VA (US)

( * ) Notice: Subject to any disclaimer, the term of this patent is extended or adjusted under 35 U.S.C. 154(b) by 0 days.

(21) Appl. No.: 14/351,412

(22) PCT Filed: Oct. 11, 2012

(86) PCT No.: PCT/US2012/059674
§ 371 (c)(1),
(2) Date: Apr. 11, 2014

(87) PCT Pub. No.: WO2013/055868
PCT Pub. Date: Apr. 18, 2013

(65) Prior Publication Data

US 2014/0299656 A1 Oct. 9, 2014

Related U.S. Application Data

(60) Provisional application No. 61/586,904, filed on Jan. 16, 2012, provisional application No. 61/545,806, filed on Oct. 11, 2011.

(51) Int. Cl.

| | |
|---|---|
| ***B65D 1/22*** | (2006.01) |
| ***B65D 5/72*** | (2006.01) |
| ***B65D 5/16*** | (2006.01) |

(52) U.S. Cl.
CPC .. *B65D 1/22* (2013.01); *B65D 5/16* (2013.01); *B65D 5/722* (2013.01)

(58) Field of Classification Search
USPC ..... 229/122.1, 243, 123; 221/303
See application file for complete search history.

(56) References Cited

U.S. PATENT DOCUMENTS

| | | | | |
|---|---|---|---|---|
| 2,909,310 | A | 10/1959 | Govang et al. | |
| 3,593,908 | A | 7/1971 | Desmond et al. | |
| 4,752,029 | A | 6/1988 | Buford | |
| 5,813,597 | A | 9/1998 | Wakevainen | |
| 5,924,559 | A * | 7/1999 | Carrel et al. | 206/45.21 |
| 6,951,300 | B2 | 10/2005 | Caille et al. | |
| 7,204,406 | B2 | 4/2007 | Bone | |

(Continued)

FOREIGN PATENT DOCUMENTS

| | | |
|---|---|---|
| DE | 4105169 | 8/1992 |
| WO | 00/76867 | 12/2000 |
| WO | WO01/72606 A1 | 10/2001 |

OTHER PUBLICATIONS

International Search Report for PCT/US2012/059674.

*Primary Examiner* — Christopher Demeree
(74) *Attorney, Agent, or Firm* — Mars, Incorporated; Amy M. Fernandez

(57) ABSTRACT

A dispenser carton including a removable bin dispenser. The removable bin dispenser forms part of the exterior surface of the carton, but may be detached from the carton to allow access to the carton. The carton has a dual dispensing feature in that the carton may either be displayed with the removable bin dispenser positioned on the carton to form a counter top dispenser configuration or a hanging configuration or the carton may be displayed with the removable bin dispenser simply removed to form a shelf-loaded carton configuration.

24 Claims, 7 Drawing Sheets

(56) References Cited

U.S. PATENT DOCUMENTS 8,770,469 B2 * 7/2014 Burke et al. ..... 229/165
2003/0098344 A1 * 5/2003 Blake ..... 229/122.1
2004/0099558 A1 5/2004 Oliff et al.
2007/0142193 A1 6/2007 Strong et al.

* cited by examiner

SHELF READY DISPLAY WITH DUAL DISPENSING FEATURES

CROSS-REFERENCE TO RELATED APPLICATIONS

The present application is a National Stage Application under 35 U.S.C. §371 of International Application No. PCT/US2012/059674, filed Oct. 11, 2012, which claims the benefit of U.S. Provisional Application No. 61/545,806, filed Oct. 11, 2011, entitled "Shelf Ready Display With Dual Dispensing Features" and claims the benefit of U.S. Provisional Application No. 61/586,904, filed Jan. 16, 2012, entitled "Shelf Ready Display with Dual Dispensing Features."

FIELD OF THE INVENTION

One or more embodiments of the present invention relate to a shelf ready display package with a dual dispensing feature that can be either a dispensing bin when the display package is placed in a standing position or a shelf opening carton when the dispensing bin is removed and the display package is laid flat.

BACKGROUND OF THE INVENTION

Display cartons with dispensing bin features have been known to be used for specialized off-shelf retail spaces such as counter tops near cash registers or in hanging configurations on shelving units either within a retail shop aisle or on the aisle end caps. However, this can leave the retailer with left over product if the off-shelf specialized retail space needs change before the product sells out.

Automated display carton assembly can include a traditional "minor-major" flap folding sequence that involves first folding the two minor flaps followed by folding an inner major flap, applying glue to the inner major flap and finally folding an outer major flap to seal and close the container. Display cartons with dispensing bin features have the added complexity of bin side panels that must remain movable. Thus, display cartons with dispensing bin features have been known to be formed with an "alternate" folding sequence that involves folding the bin side panel and then folding an inner major flap, followed by folding the minor flaps, applying glue and then folding the remaining major flap to seal and close the display container. The complexity of the bin side panels makes these display cartons expensive to form.

BRIEF SUMMARY OF THE INVENTION

One or more of the embodiments of the present invention provide a dispenser carton including a removable bin dispenser that forms part of the exterior surface of the carton. The carton has a dual dispensing feature in that the carton may either be displayed with the removable bin dispenser positioned on the carton to form a counter top dispenser configuration or a hanging configuration or the carton may be displayed with the removable bin dispenser simply removed to form a shelf-loaded carton configuration.

DETAILED DESCRIPTION OF THE INVENTION

Figure 1:
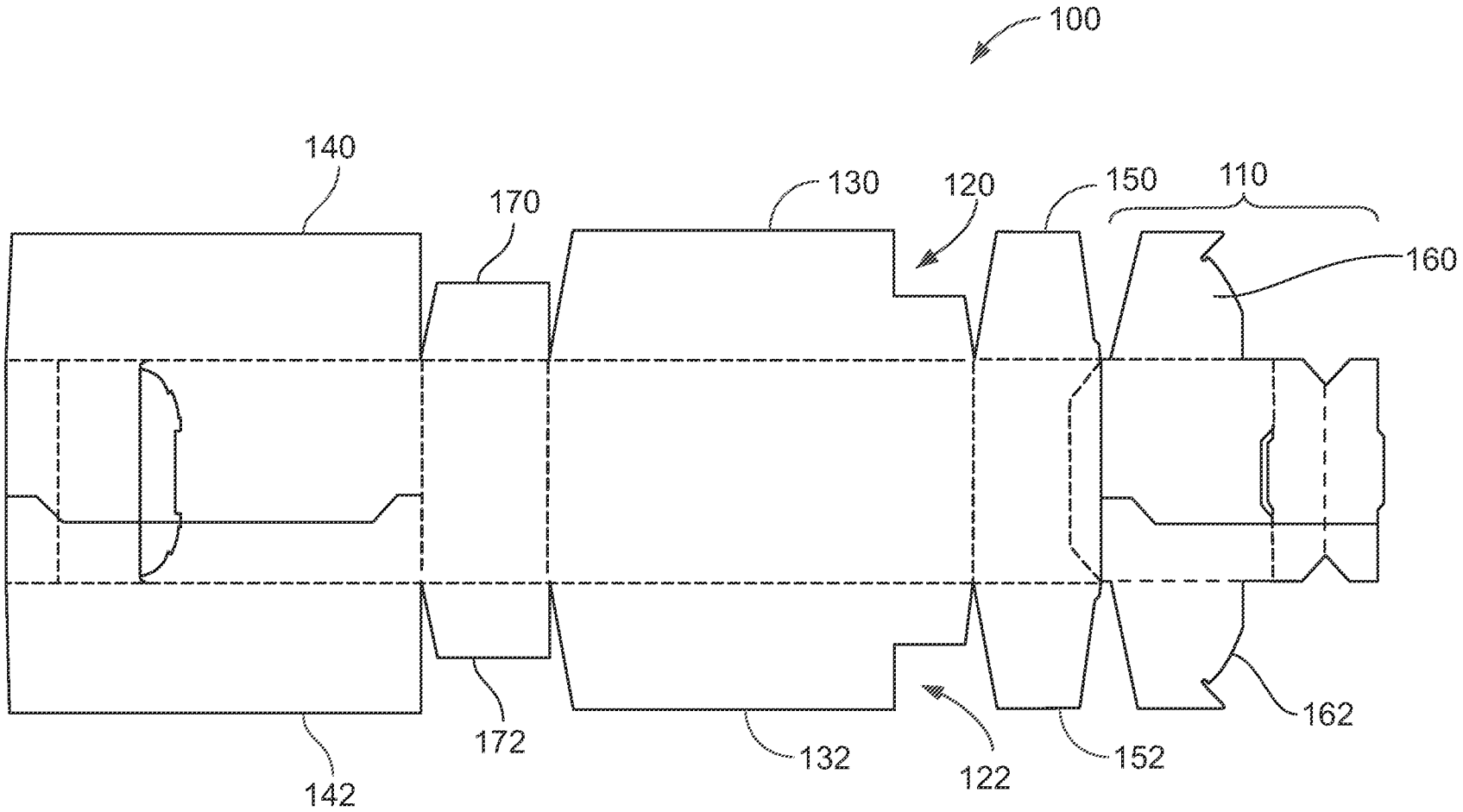
FIG. 1 illustrates an automatic sleeve bin-fold dispenser carton according to one embodiment of the present invention.

The shelf ready display with dual dispensing features is a unique approach for the assembly of a dispensing carton using a standard sleeve-style design with the traditional "minor-major" flap folding sequence.

Current dispenser designs (for candy or some similar consumer product) are often built using an "alternate" fold sequence of the minor and major flaps which are glued together. This technique preferably results in a carton which remains intact even after the dispenser feature is activated.

While this design approach has been proven a strong performer, the problem is that it may be difficult to produce in certain packaging and/or manufacturing plants, depending on plant configuration and capability. If the packaging is not able to be produced in the plant, the manufacturer may have to send the goods to an external packager, such as a packager with offsite co-pack resources. This may increase the cost of goods sold (COGs), add complexity, and may hamper the manufacturer's ability to improve their speed to market.

The new shelf ready display with dual dispensing features carton resolves this by using a modified major flap shape that includes a cut out area on the inside major flap which is positionable so that the outside major flap can be adhered to the minor flap covering the removable bin dispenser flap and the inside major flap without adhering to the removable bin dispenser flap. The modified major flap shape allows use of the traditional folding sequence and a specific glue application as further described below. This makes the implementation more efficient in that it fits within the functional operations of automated carton equipment. In some embodiments, the cut out area is on one end of the inside major flap while in other embodiments, both ends of the inside major flap have cut out areas. In some embodiments the shape and size of the cut out area can be sized to provide a desired glue application or a desired adhesive strength. For example, in some embodiments, the size of the cut out area allows for an increased amount of glue application to provide an increased adhesive strength. In some embodiments, the glue application can be performed in a single step while in other embodiments glue can be applied in two or more steps. When the glue is applied in two or more steps, one of the steps can be a glue application to the minor flap in the region of the inside major flap cut out area and another step can be a glue application to the inside major flap in the region where the outside major flap will be adhered to the inside major flap.

One advantage is that by using a traditional flap fold sequence, the equipment required to run this design is less complex in that there is one less folding station needed. As a result, the actual length of the machine will also tend to be shorter thereby reducing the footprint required on the production floor.

Dispenser type carton designs have been used successfully for over a decade, in the highly competitive arena of off-shelf merchandising for immediate consumption products. The implementation of this dispenser design help manufacturers to further optimize the total cost of the effected items by enabling certain items to be made online, in the Plants, thus saving substantial cost and adding efficiency to production. Additionally, by providing the option of converting the dispensing bin into a shelf opening carton, retailers can move the carton from an off-shelf location to a shelf when the need arises. Other packages that place the shelf opening feature on a face opposite to the bin dispensing opening force the retailer to choose a retailing space prior to opening the display. The shelf ready display with dual dispensing features gives the retailer the flexibility of first using the bin dispensing feature and then removing that feature to place the display on a standard shelf.

FIG. 1 illustrates an automatic sleeve bin-fold dispenser carton 100 according to one embodiment of the present invention. The carton 100 includes a removable dispenser 110, a first cut out area 120, a second cut out area 122, a top inside major flap 130, a bottom inside major flap 132, a top outside major flap 140, a bottom outside major flap 142, a top minor flap 150, a bottom minor flap 152, a top removable bin dispenser flap 160, a bottom removable bin dispenser flap 162, a top secondary minor flap 170, and a bottom secondary minor flap 172.

As shown in FIG. 1, the carton is preferably composed of a single piece of carton material such as paperboard or stiffened paper. For additional structural stability, the carton material can include a fluted intermediate layer. The carton material may be folded to form a container and the flaps on the top and bottom of FIG. 1 may be glued together.

As mentioned above, the carton 100 also includes a removable bin dispenser 110. The removable bin dispenser is preferably attached to the rest of the carton material in a detachable fashion, such as by using perforations or partial cutting of the carton material. As shown in the Figures below, the removable dispenser 110 may be removed from the carton 100 to allow the carton 100 to display its contents.

The carton 100 also includes a first cut out area 120 in the top inside major flap 130 and a second cut out area 122 in the bottom inside major flap 132. The cut out areas are preferably positioned so that the outside major flaps 140, 142 can be adhered to the minor flaps 150, 152 covering the removable bin dispenser flaps 160, 162 and the inside major flaps 130, 132 without adhering to the removable bin dispenser flap 160, 162.

In some embodiments, the depth of the carton and thus the height of the side panels is increased or maximized to allow for bin side panels that are as large as possible. Increasing the side panel height and corresponding bin side panel size enables the bin dispenser to open at are larger angle thus creating a larger open area for product dispensing. However, the side panel height may be restricted by the height of shelf where the shelf pack may be shelved. In some embodiments, the side panel has a height of from about 3.5 in. to about 4.0 in. In some embodiments, the bin dispenser opens to an angle of from about 35 degrees to about 55 degrees.

Figure 2:
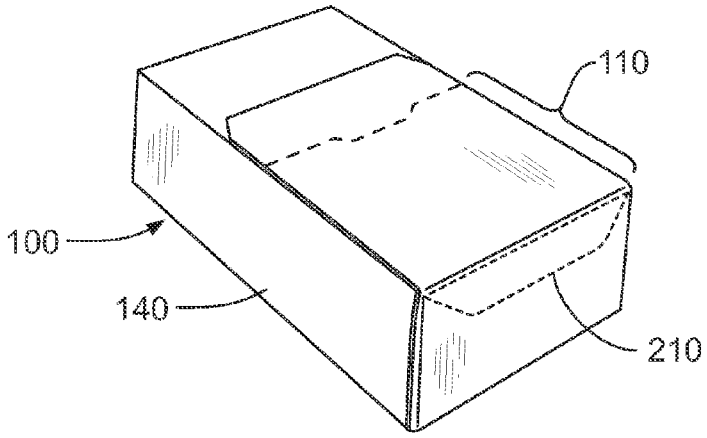
FIG. 2 illustrates the fully assembled carton of FIG. 1.

FIG. 2 illustrates the fully assembled carton 100 of FIG. 1. As shown in FIG. 2, an described above, the carton 100 is preferably filled with product and assembled by gluing or adhering the flaps together. FIG. 2 also shows the removable dispenser 110, but it has not yet been removed from the carton 100. The removable dispenser 110 is preferably attached to the carton 100 along a bottom perforation 210. The removable bin dispenser flaps 160, 162 are folded under the outside major flaps 140, 142.

Figure 3:
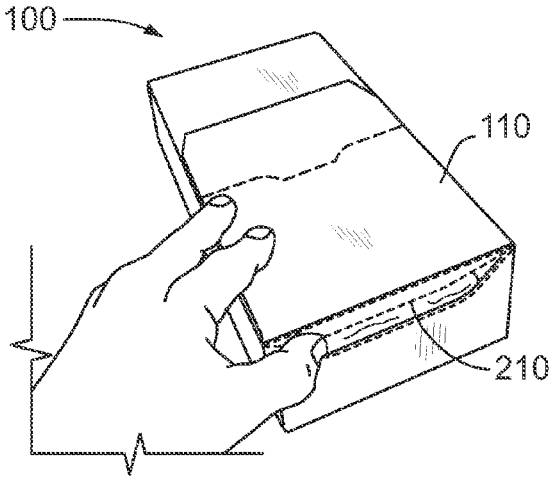
FIG. 3 illustrates the fully assembled carton of FIG. 1 wherein the bottom perforation has been separated from the rest of the carton.

FIG. 3 illustrates the fully assembled carton 100 of FIG. 1 wherein the bottom perforation 210 has been separated from the rest of the carton. Separating the bottom perforation 210 from the rest of the carton 100 is the first step in removing the removable dispenser 110.

Figure 4:
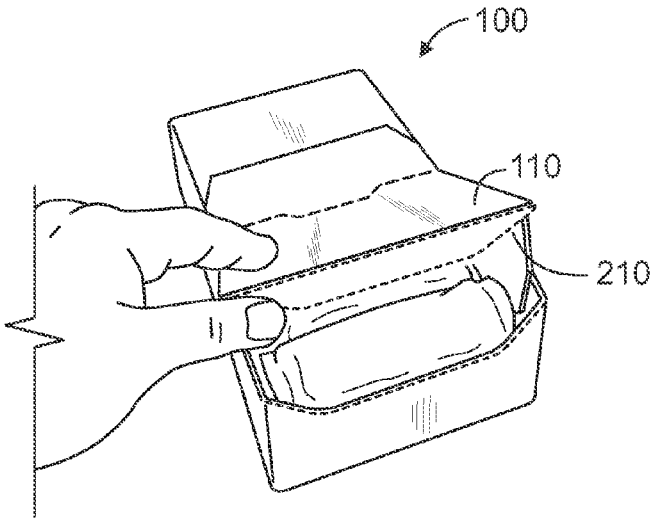
FIG. 4 illustrates the carton of FIG. 1 with the bottom perforation separated and the removable dispenser beginning to be slid out of the carton.

FIG. 4 illustrates the carton 100 of FIG. 1 with the bottom perforation separated and the removable dispenser 110 beginning to be slid out of the carton 100. In one embodiment, the removable dispenser 110 is not attached to the carton 100 at the sides and may be simply slid out of the carton 100 after the bottom perforation 210 has been separated. In another embodiment, the removable dispenser is attached to the carton 100 at the sides with side perforations that are separated as the removable dispenser 110 is removed from the carton 100. Additionally, the removable dispenser 110 may be configured so that the top part of the removable dispenser merely rests in place against the surface of the carton 100. Alternatively, top part of the removable dispenser 110 may be attached to the carton 100 using a top perforation. The top perforation may be at the extreme end of the removable dispenser, or an additional surface may be positioned under the extreme end of the removable dispenser in perforated attachment with the carton 100.

Figure 5:
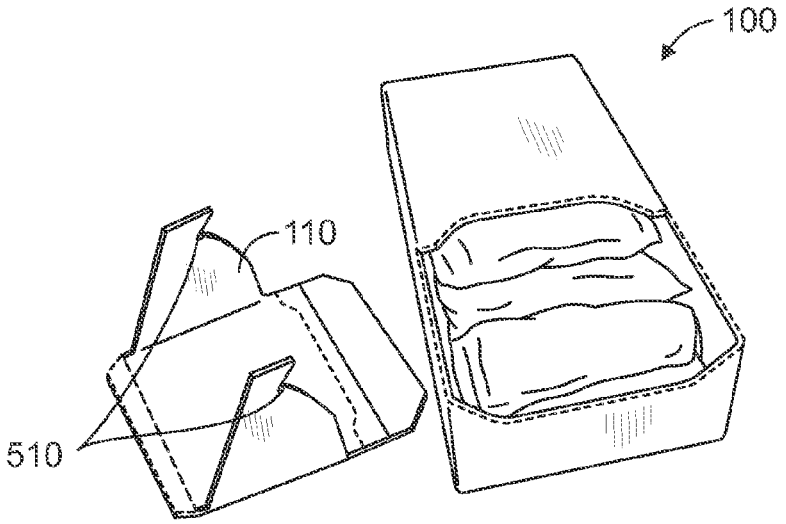
FIG. 5 illustrates the carton of FIG. 1 with the removable dispenser removed from the carton.

FIG. 5 illustrates the carton 100 of FIG. 1 with the removable dispenser 110 removed from the carton 100. The removable dispenser 110 includes a plurality of notches 510 that may engage the carton 100 when the removable dispenser 110 is in an open position and prevent the removable dispenser from becoming disengaged from the carton which could cause the product inside the container to spill out.

Figure 6:
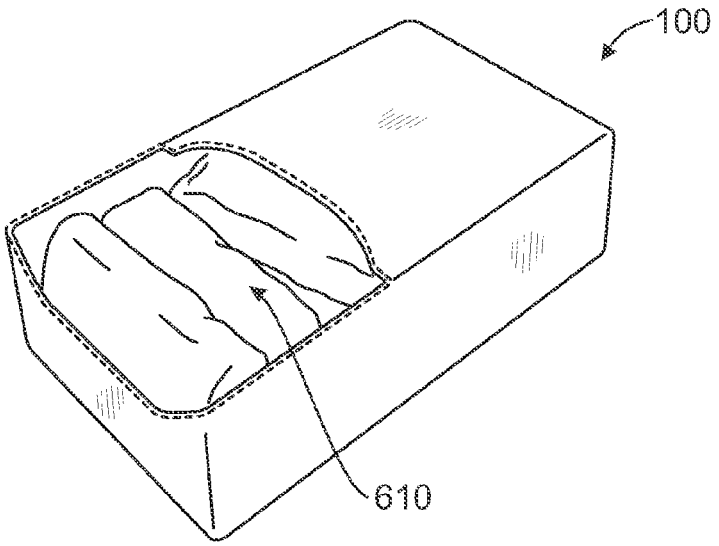
FIG. 6 illustrates a standard shelf-loaded carton configuration of the carton.

FIG. 6 illustrates a standard shelf-loaded carton configuration of the carton 100. In the standard shelf-loaded carton configuration, the removable dispenser 110 is simply discarded. To facilitate use of the carton as a lay-down shelf display, the removable dispenser 110 has been configured so that when it is removed it leaves an aperture 610 in the carton 100 sufficient to allow access to the product when the carton 100 is positioned on a shelf.

Figure 7:
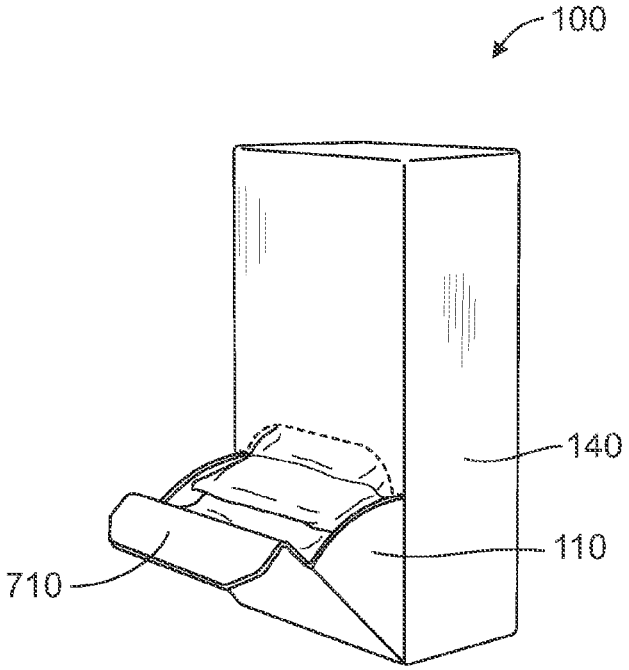
FIG. 7 illustrates a counter top dispenser configuration of the carton.

FIG. 7 illustrates a counter top dispenser configuration of the carton 100. As shown in FIG. 7, the removable dispenser 110 is in an open configuration relative to the interior of the carton 100. Additionally, the front tab of the removable dispenser 110 has been folded down to provide a power wing 710. The power wing 710 both allows for additional advertising display and assists in providing structural strength to the front edge of the removable dispenser 110.

Figure 8:
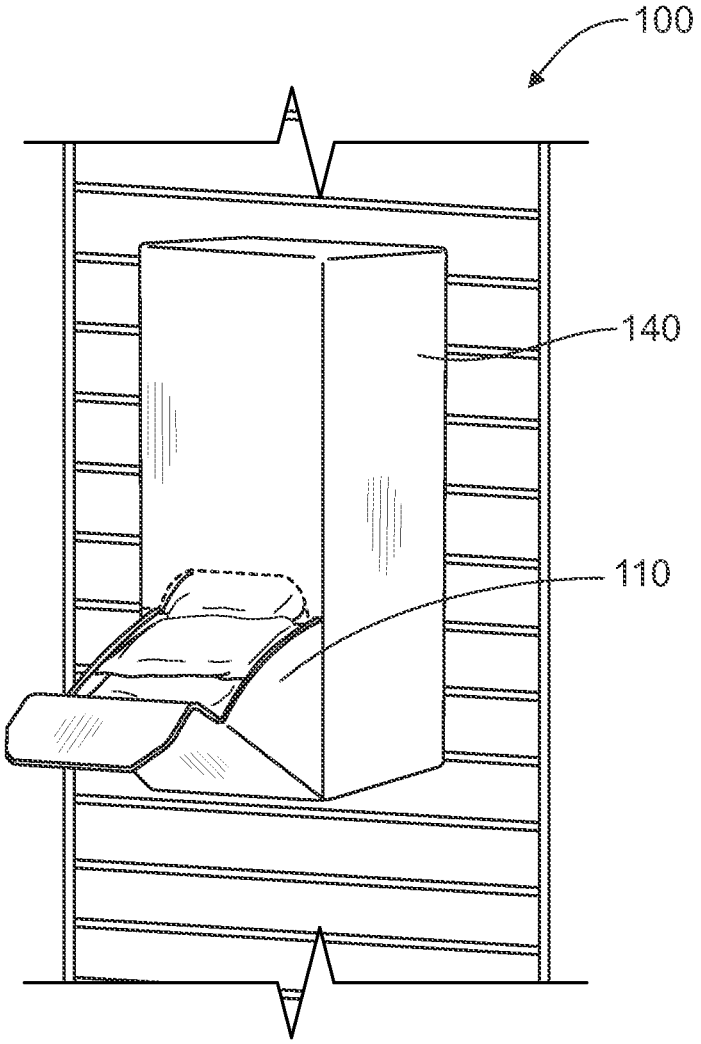
FIG. 8 illustrates the hanging configuration of the carton.

FIG. 8 illustrates the hanging configuration of the carton 100. The hanging configuration is similar to the counter top dispenser configuration of FIG. 7 with regard to the installation and positioning of the removable dispenser. However, instead of the bottom of the carton 100 being supported by a counter, the carton 100 is instead hung from a shelf or rack. Many methodologies of hanging such cartons from shelves or racks are known in the art. To facilitate hanging the dispensing carton, a slot on the back facing of the carton can be included.

Thus, as shown in FIGS. 2-8, a displayer such as a retailer may first use the dispensing carton as a counter top or hanging unit and then remove the removable dispenser 110 from the remainder of the carton 100, and display the carton as a lay-down shelf unit.

Additionally, as mentioned above, in the hanging and counter top displays, a tab or power wing 710 hangs downward from the front of the removable dispenser 110. The power wing 710 adds strength to the removable dispenser and may thus prevent deformation of the removable dispenser when employed as a bin dispenser. Also, the power wing 710 facilitates opening the removable dispenser and may be used to provide additional communication. In some embodiments, the power wing 710 may be displayed or removed. Additionally the power wing may be referred to as a display flap.

Figure 9:
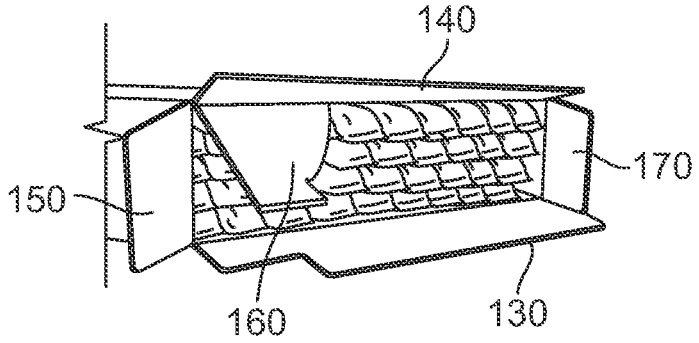
FIG. 9 illustrates a first step in a folding sequence for assembling the carton.

FIG. 9 illustrates a first step in a folding sequence for assembling the carton 100. As shown in FIG. 9, the removable bin dispenser flap 160 is folded down. The inside major flap 130, outside major flap 140, minor flap 150, and secondary minor flap 170 remain unfolded.

Figure 10:
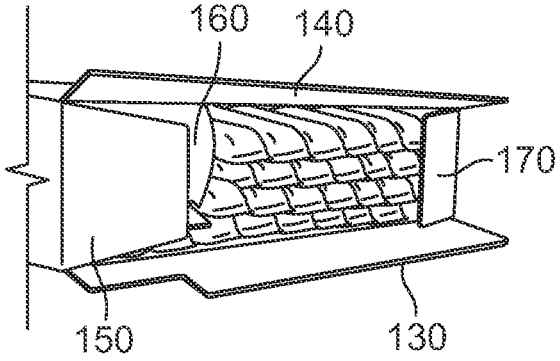
FIG. 10 illustrates a second step in a folding sequence for assembling the carton.

FIG. 10 illustrates a second step in a folding sequence for assembling the carton 100. As shown in FIG. 10, minor flap 150 is now folded over the removable bin dispenser flap 160. Additionally, the secondary minor flap 170 is also folded down. The inside major flap 130 and outside major flap 140 remain unfolded.

Figure 11:
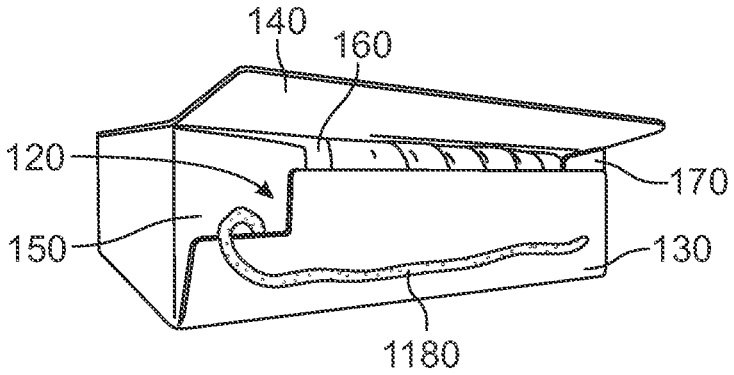
FIG. 11 illustrates a third step in a folding sequence for assembling the carton.

FIG. 11 illustrates a third step in a folding sequence for assembling the carton 100. As shown in FIG. 11, the inside major flap 130 is folded up. The inside major flap 130 includes a cutout area 120 positioned over the left minor flap. Additionally, an adhesive 1180 such as glue is applied to the exterior surface of the insider major flap 130. The adhesive is preferably applied to both the minor flap 150 and along the bottom of the inside major flap 130 to allow the outside major flap 140 to adhere to both the minor flap 150 and the inside major flap 130 once the outside major flap 140 is folded down. Once the outside major flap 140 is thus adhered, the carton 100 has been formed. It is preferred to glue the bottom and top flaps of the carton to the left flap (minor flap 150) rather than the removable bin dispenser flap to allow the removable bin dispenser to be easily from the carton without adversely impacting the carton's structural integrity.

Figure 12:
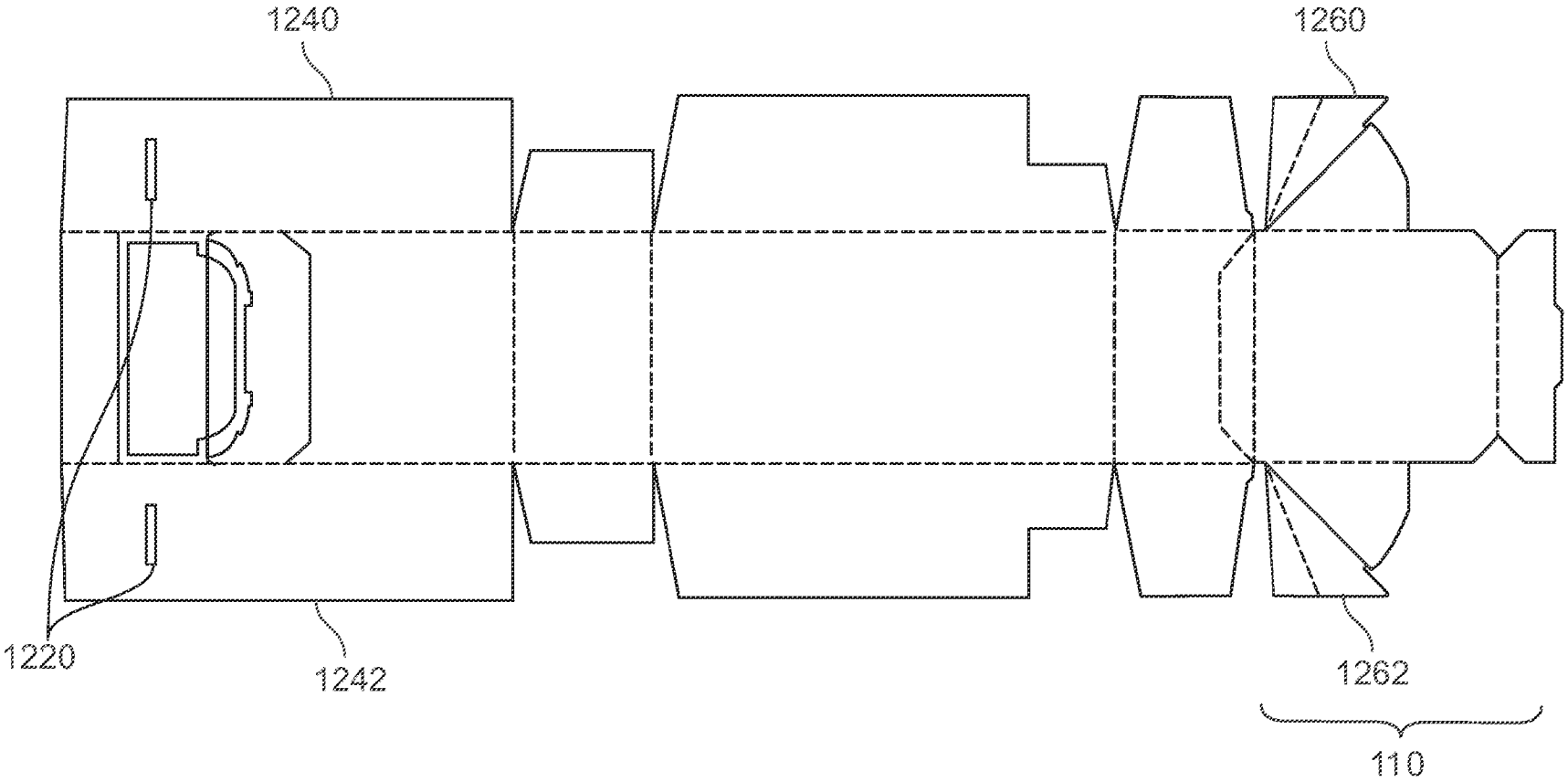
FIG. 12 illustrates an alternative embodiment of the carton of FIG. 1 including cutouts and slots.

FIG. 12 illustrates an alternative embodiment of the carton 100 of FIG. 1 including slots 1220. As shown in FIG. 12, slots 1220 are positioned in the top outside major flap 1240 and/or the bottom outside major flap 1242. This embodiment may provide an advantage in performing the fold sequence. More specifically, in one embodiment the fold sequence requires folding down the removable bin flaps 1260, 1262 as the first step, but the outside major flaps 1240, 1242 may somewhat block access to the bin fold flaps. This may make it difficult to start the fold sequence. Consequently, this embodiment provides a plurality of access slots to allow the carton 100 to be more conveniently folded. For example, the carton folding machine or apparatus may include an arm or other mechanical contact that may extend through access slots 1220 to assist in folding the bin flaps 1260, 1262 down.

Stated another way, as shown in FIG. 12, one or more of the outside major flaps may include an access slot positioned so that a folding arm may access said removable bin dispenser flap to initiate folding the removable bin dispenser flap.

Figure 13:
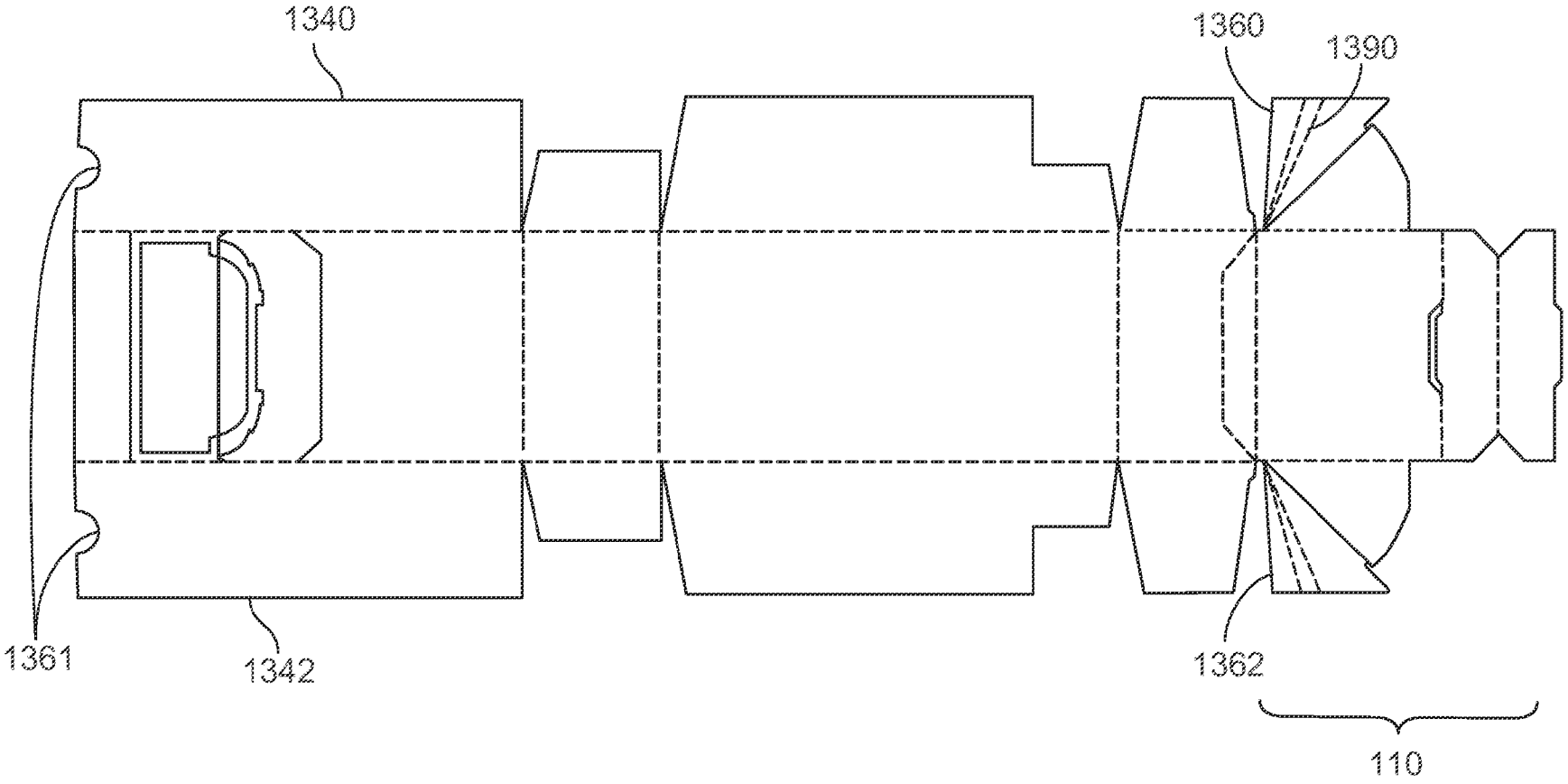
FIG. 13 illustrates an alternative embodiment of the carton of FIG. 1 including extended removable bin flaps.

FIG. 13 illustrates an alternative embodiment of the carton 100 of FIG. 1 including extended removable bin flaps 1360, 1362 and access cut outs 1361. More specifically, the top extended removable bin flap 1360 and/or the bottom extended removable bin flap 1362 may be configured so that the portion of the bin flap that extends toward the remainder of the carton 100 describes an angle closer to vertical than another configuration 1390 of the bin flap. Consequently, when the carton 100 is assembled as shown in FIG. 9, the portion of the bin flap nearest the minor flap 150 may fold down in a more nearly vertical configuration and/or nearer to the base of the minor flap 150. Access cut outs 1361 are positioned in the top outside major flap 1340 and/or the bottom outside major flap 1342. As with the embodiment of FIG. 12, the access cut outs 1361 provide a plurality of access areas to allow the carton 100 to be more conveniently folded. For example, the carton folding machine or apparatus may include an arm or other mechanical contact that may extend through access cut outs 1361 to assist in folding the bin flap down.

As with the alternative embodiment of FIG. 12, the alternative embodiment of FIG. 13 may provide an advantage in performing the fold sequence. More specifically, in one embodiment the fold sequence requires folding down the removable bin flap as the first step, but the outside major flaps may somewhat block access to the bin fold flap. This may make it difficult to start the fold sequence. Consequently, this embodiment provides a more accessible angle to the removable bin flap to allow the carton 100 to be more conveniently folded. For example, the carton folding machine or apparatus may include an arm or other mechanical contact that may engaged the extended portion of the removable bin flap.

Stated another way, as shown in FIG. 13, the removable bin dispenser flap may include an extension that may be called a fold initiation area. Further, one or more of the outside major flaps may include an access cut out positioned over the fold initiation area to initiate folding the removable bin dispenser flap.

The alternative embodiments of FIGS. 12 and 13 may be employed separately or used together.

As an alternative description, the carton may be referred to as a pack. The pack is a shelf ready display pack with a dual opening feature that may be a dispensing bin opening and/or a standard shelf opening because both opening features are preferably on the same facing. Providing the retailer with the flexibility of using the display as a special pack with the dispensing bin and then converting it to a standard shelf pack provides the retailer with more confidence in purchasing the pack because the retailer is not limited to using it as a special display. The retailer may initially set the display up as a special pack with the dispensing bin and may then remove the dispensing bin and move it to a standard shelf if the product is not moving fast enough or if retail space needs change.

Additionally, the carton is preferably formed by using a standard flap folding sequence (minor flaps followed by inner major flap followed by outer major flap) that allows use of automated carton forming equipment. The standard sequence is possible by first folding the bin side flap and then executing the standard sequence. Individually wrapped confectionery goods are side loaded into the carton. Flexible packs like M&M's singles bags are shingled upon loading to facilitate dispensing via the bin. In some embodiments, the carton can hold 3-9 lbs. of product while in other embodiments, the carton can hold 5-8 lbs. while in still other embodiments, the carton can hold 7-8 lbs. of product.

The use of a fluted intermediate layer in the paperboard material of the carton may provide enough strength to potentially eliminate the tertiary shipper package. In some embodiments, the use of a fluted intermediate creates a bin dispensing display that holds from about 5 lbs. to about 15 lbs. of product.

In some embodiments, when the carton is formed, one or more product packs may be placed inside the carton. The carton may be formed around the product packs or the product packs may be inserted into the carton before or during the folding process.

In some embodiments, the product packs may be shingled with other product packs. Shingling is often described as the process of aligning or stacking packaged products such that the bottom of an upper packaged product covers the top of a lower packaged product or the other way around (top of a lower packaged product covers the bottom of an upper packaged product) and may be similar in appearance to roof shingles. In some embodiments, the shingled product packs may be oriented in the carton so as to facilitate gravitational flow of the product packs out of the bin dispenser Also as shown in FIG. 1, the removable bin flaps include a notch. The notch is usable to position the degree of opening of the bin flap relative to the carton. In one embodiment, the notches of the bin flaps contact an interior edge of the carton and are rotatable by a user to rotate the bin flap into any position from a closed position with the top of the removable dispenser contacting the carton to an open position wherein the top of the removable dispenser is rotated away from the carton by a significant angle such as 45 or 60 degrees, for example.

Additionally, as mentioned above, the area of perforation shown in FIG. 4 provides the ability to remove the bin side flaps to form the shelf opening. Typically, a manufacturer would not form such a structure at this location because the perforation may be viewed as weakening the structural integrity of the carton, which is typically undesirable at the bottom of the bin. Conversely, in one of the present embodiments, a fluted intermediate layer of paperboard material may be placed on the interior side of this area in order to compensate for a potential weakening of structural integrity.

Additionally, the adhesive or glue used to join one or more of the flaps may be selected from the group consisting of pressure sensitive adhesive, hot melt adhesive, cold melt adhesive, and combinations thereof. Cold melt adhesive or cold seal adhesive may be preferred because it has the advantage of taking some time to set up which allows some movement of the flaps prior to fixation and then provides a stronger seal.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A dispenser carton including:

a plurality of major flaps including a top inside major flap, a bottom inside major flap, a top outside major flap, and a bottom outside major flap, wherein said top inside major flap and bottom inside major flap both include a cut out area, a plurality of minor flaps including a top minor flap, a bottom minor flap, a top secondary minor flap and a bottom secondary minor flap, a removable bin dispenser including a top removable bin dispenser flap and a bottom removable bin dispenser flap, wherein said top and bottom removable bin dispenser flaps include a notch, wherein said removable bin dispenser is formed of the material of a carton, wherein said cut out areas of said top inside major flap and said bottom inside major flap are positioned so that the outside major flaps can be adhered to the top and bottom minor flaps, overlapping the top and bottom removable bin dispenser flaps and the top and bottom inside major flaps, without adhering to said top and bottom removable bin dispenser flaps, and wherein said removable bin dispenser may be separated from said carton to display the contents of said carton.

2. The dispenser carton of claim 1 wherein said removable bin dispenser is composed of paperboard.

3. The dispenser carton of claim 1 wherein said removable bin dispenser is composed of stiffened paper.

4. The dispenser carton of claim 1 wherein said removable bin dispenser includes a fluted intermediate layer.

5. The dispenser carton of claim 1 wherein said removable bin dispenser includes a display flap.

6. The dispenser carton of claim 1 wherein said notch is usable to position said removable bin dispenser in an open position relative to said carton.

7. The dispenser carton of claim 1 wherein said top and bottom outside major flaps include an access slot positioned so that a folding arm can access said top and bottom removable bin dispenser flaps to initiate folding of said top and bottom removable bin dispenser flaps.

8. The dispenser carton of claim 7 wherein said top and bottom removable bin dispenser flaps include a fold initiation area.

9. The dispenser carton of claim 1 including an adhesive applied to said top inside major flap and top minor flap.

10. The dispenser carton of claim 9 wherein said adhesive is selected from the group consisting of pressure sensitive adhesive, hot melt adhesive, cold melt adhesive, and combinations thereof.

11. The dispenser carton of claim 9 wherein said adhesive is cold seal adhesive.

12. The dispenser carton of claim 1 wherein said removable bin dispenser includes a front tab that may be folded down to form a power wing.

13. The dispenser carton of claim 1 wherein said removable bin dispenser includes a bottom perforation.

14. The dispenser carton of claim 1 wherein said removable bin dispenser is positionable in one of a plurality of configurations to display the contents of said dispenser carton.

15. The dispenser carton of claim 1 wherein said removable bin dispenser is positionable in a first configuration by separating a portion of said removable bin dispenser from said dispenser carton to allow said removable dispenser to rotate open relative to said dispenser carton.

16. The dispenser carton of claim 1 wherein said removable bin dispenser is positionable in a second configuration by separating at least a portion of said removable bin dispenser from said dispenser carton to form an aperture into said dispenser carton.

17. The dispenser carton of claim 16 wherein said removable bin dispenser is at least partially separated from said dispenser carton along a bottom perforation.

18. A method of forming dispenser carton, said method including:

providing a dispenser carton having:

a plurality of major flaps including a top inside major flap a bottom inside major flap, a top outside major flap, and a bottom outside major flap, wherein said top inside major flap and bottom inside major flap both include a cut out area, a plurality of minor flaps including a top minor flap, a bottom minor flap, a top secondary minor flap and a bottom secondary minor flap, a removable bin dispenser including a top removable bin dispenser flap and a bottom removable bin dispenser flap;

positioning said dispenser carton so that said major flaps, minor flaps, and removable bin dispenser flaps are foldable inwardly to form a side of said dispenser carton;

folding inward said removable bin dispenser flaps;

folding inward said top minor flap and said bottom minor flap so that said top and bottom minor flap cover said top and bottom removable bin dispenser flap;

folding inward said top and bottom inside major flaps so that their respective cut out areas are positioned over said top and bottom minor flaps;

positioning an adhesive on the exterior face of said top and bottom inside major flaps and said top and bottom minor flaps; and folding inward said top and bottom outside major flaps to overlap said top and bottom inside major flaps and contact said adhesive to adhere said top and bottom outside major flaps to said top and bottom inside major flaps.

19. The method of claim 18 wherein said positioning said adhesive includes a first positioning on the exterior face of said top minor flap and a second positioning on the exterior face of said top inside major flap.

20. The method of claim 18 wherein a product is positioned in said dispenser carton before folding inward said removable bin flap.

21. The method of claim 20 wherein said product is side loaded into said carton.

22. The method of claim 20, wherein said product is shingled.

23. The method of claim 18 wherein said adhesive is selected from the group consisting of pressure sensitive adhesive, hot melt adhesive, cold melt adhesive, and combinations thereof.

24. The method of claim 18 wherein said adhesive is a cold melt adhesive.

* * * * *